US005490461A

United States Patent [19]

Beaudoin

[11] Patent Number: 5,490,461

[45] Date of Patent: Feb. 13, 1996

[54] TAG AND LABEL PRINTING PRESS

[76] Inventor: Leon W. Beaudoin, 59 Driftwood La., Trumbull, Conn. 06611

[21] Appl. No.: 444,230

[22] Filed: May 18, 1995

[51] Int. Cl.[6] ..... B41F 31/06

[52] U.S. Cl. ..... 101/483; 101/219; 101/479

[58] Field of Search ..... 101/216, 219, 101/225, 226, 327, 483, 479, 480, 138, 141, 142

[56] References Cited

U.S. PATENT DOCUMENTS

| | | | |
|---|---|---|---|
| 168,115 | 9/1875 | Tuchfarber | 101/216 |
| 372,302 | 11/1877 | McMahon | 101/216 |
| 573,407 | 12/1896 | Hale | 101/216 |
| 3,092,021 | 6/1963 | Gruver | 101/216 |
| 3,470,816 | 10/1969 | Piecha et al. | 101/216 |
| 3,972,283 | 8/1976 | Jennings | 101/226 |
| 4,023,490 | 5/1977 | Marozzi | 101/219 |
| 4,527,472 | 7/1985 | Davison | 101/219 |
| 4,821,642 | 4/1989 | Schafer | 101/219 |
| 4,932,322 | 6/1990 | Keller | 101/219 |
| 5,186,553 | 2/1993 | Sugiura et al. | 400/208 |

OTHER PUBLICATIONS

Advertisement, tag and label press, Webtron Corporation, 1969, pp. 1–14.

*Primary Examiner*—Eugene H. Eickholt
*Attorney, Agent, or Firm*—Perman & Green

[57] ABSTRACT

A printing station for a tag and label printing press. The printing station extends outwardly from a frame of the printing press. The printing station has printing roller, an ink roller, and a backing roller. A frame extension is provided for connected outward ends of the rollers to each other. An upper section of the extension frame is movable relative to the printing press frame and movable relative to a lower section of the extension frame. The upper section has the printing roller. The lower section has the ink roller and the backing roller. The extension frame connects the outward ends of the rollers to each other outwardly from the rollers' outward ends.

14 Claims, 4 Drawing Sheets

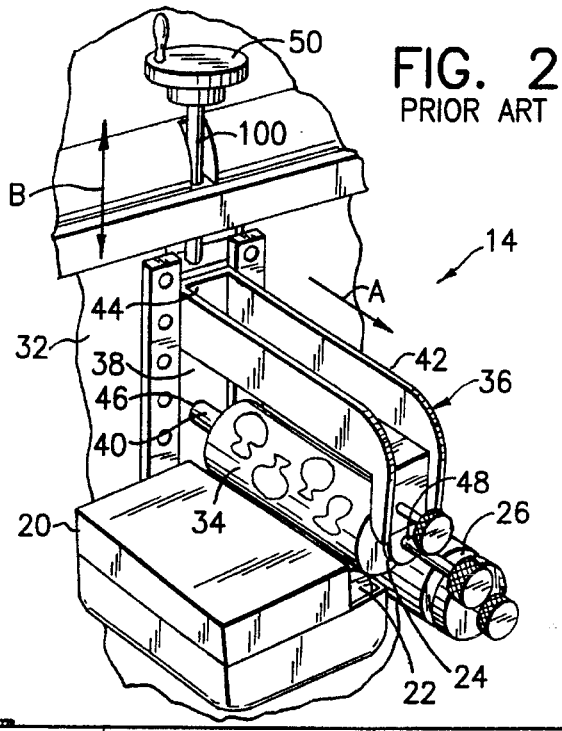
FIG. 2
PRIOR ART
FIG. 3
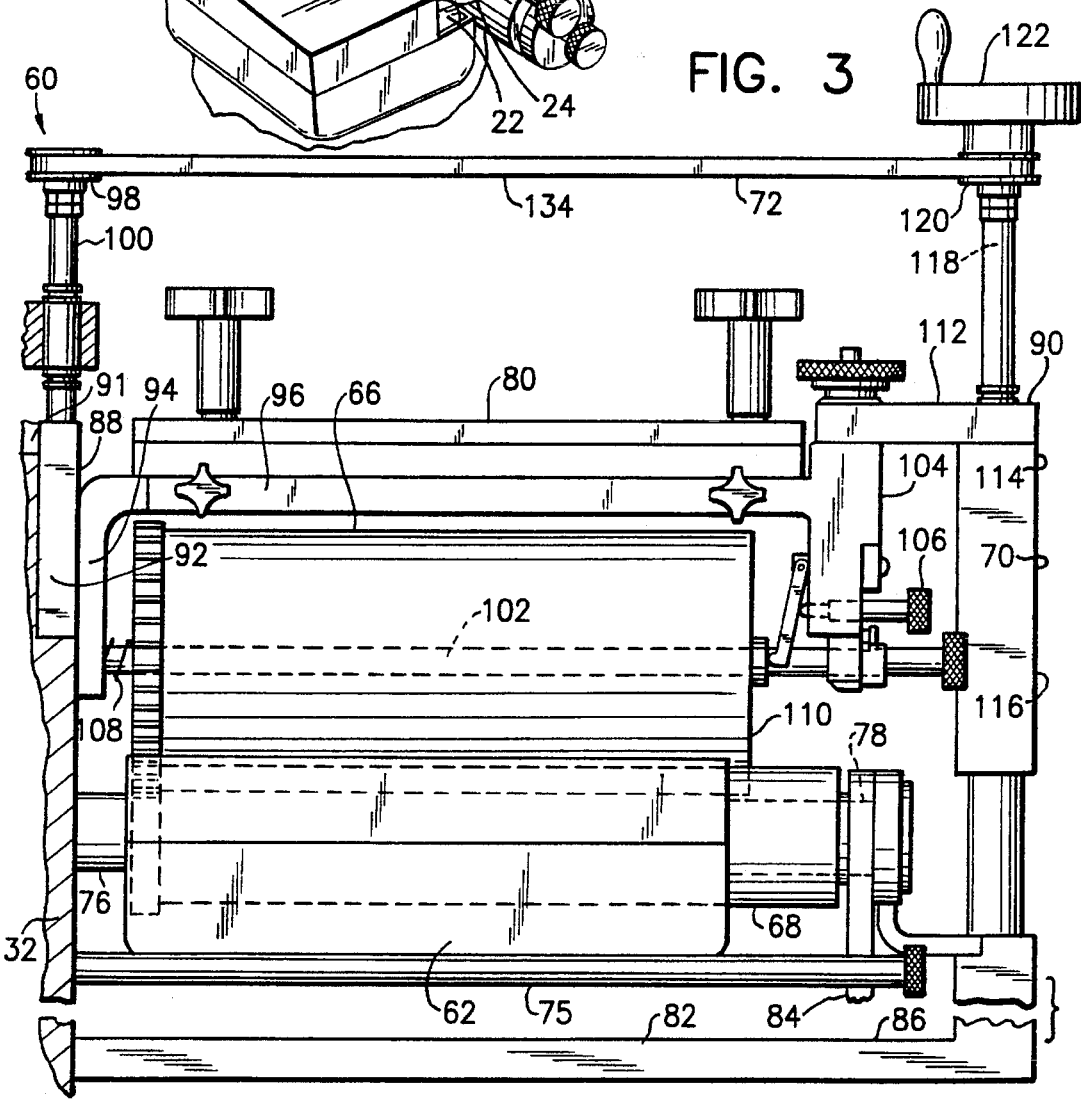

TAG AND LABEL PRINTING PRESS

BACKGROUND OF THE INVENTION

1. Field of the Invention

The present invention relates to a printing press and, more particularly, to a printing station in a tag and label printing press.

2. Prior Art

Webtron Corporation of Fort Lauderdale, Fla., sells tag and label printing presses. The Webtron printing presses has multiple printing stations for applying different colors to a web being passed through the printing stations. Rollers of the printing stations are cantilever mounted on a frame of the printing press in an outward direction. This allows an operator to closely examine the operation during printing along the front of the press with a substantially unobstructed view, and access to the printing stations as required.

SUMMARY OF THE INVENTION

In accordance with one embodiment of the present invention, in a tag and label printing press having an unwind station, printing stations and a final product station arranged in series relative to each other, the printing stations being serially arranged on a frame of the printing press, each printing station having an ink roller, a printing roller and a backing roller, all of the printing station rollers extending outwardly from the frame, the improvement comprises at least one of the printing stations having a frame extension connecting outward ends of the printing station rollers to each other.

In accordance with one method of the present invention, a method of modifying a tag and label printing press is provided comprising steps of removing a generally cantilevered printing roller support frame from a frame of the printing press, the support frame having been movably mounted on the printing press frame; and connecting a frame extension to the printing press frame. A first portion of the frame extension is movably mounted to the printing press frame at a location where the support frame was previously mounted to the printing press frame. A second portion of the frame extension is stationarily connected to the printing press frame.

In accordance with another embodiment of the present invention, a printing station for a tag and label printing press is provided. The printing station comprises rollers and a frame. The rollers include a printing roller and a backing roller. The frame has a first section with a first end movably connectable to a printing press frame and a second end connected to an outward end of the printing roller, and a second section with a third end connected to an outward end of the backing roller and a fourth end stationarily connectable to the printing press frame. The first and second sections are movably connected to each other.

BRIEF DESCRIPTION OF THE DRAWINGS

The foregoing aspects and other features of the invention are explained in the following description, taken in connection with the accompanying drawings, wherein:

FIG. 2 is a partial perspective view of one of the printing stations in the printing press shown in FIG. 1;

FIG. 3 is a side view of a printing station incorporating features of the present invention;

DETAILED DESCRIPTION OF THE PREFERRED EMBODIMENT

Figure 1:
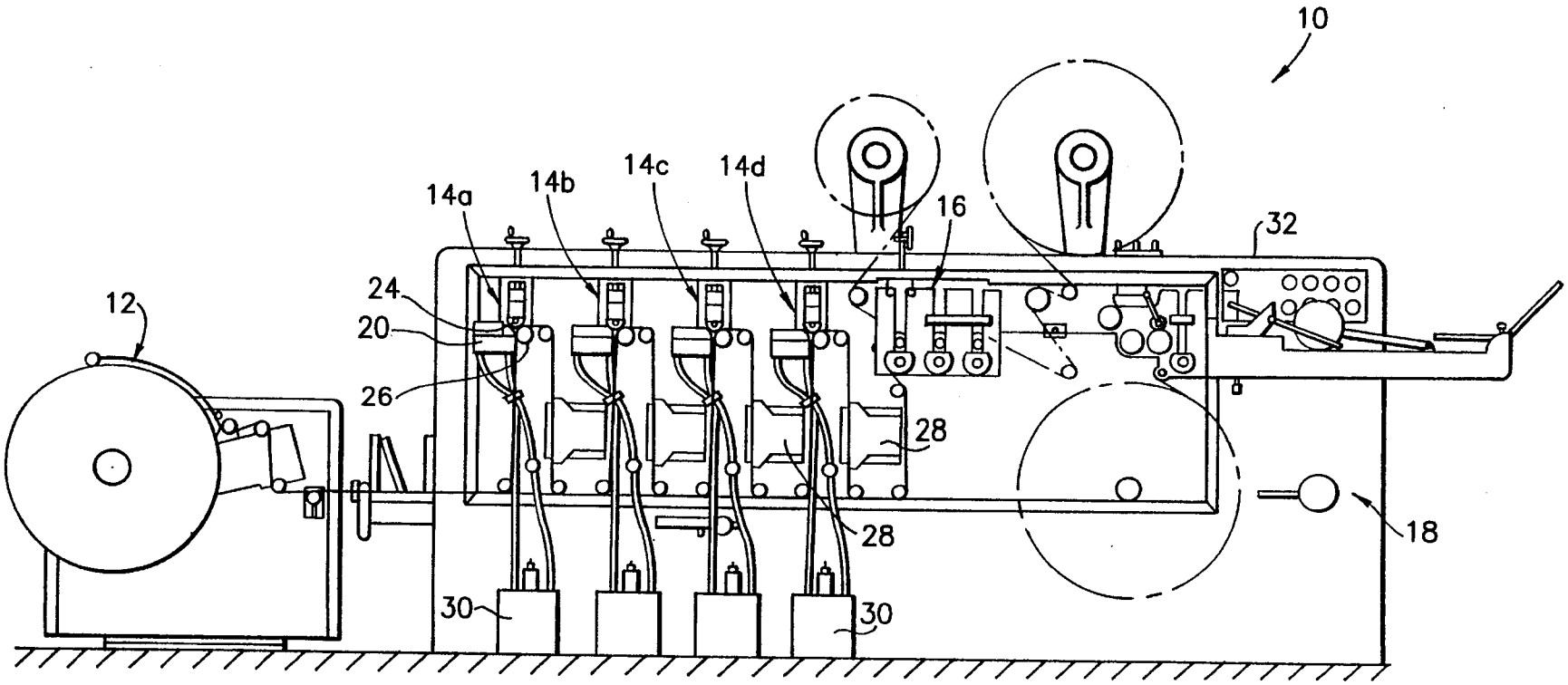
FIG. 1 PRIOR ART
FIG. 1 is a schematic elevational front view of a tag and label printing press known in the prior art.

Referring to FIG. 1, there is shown a schematic front elevational view of a tag and label printing press 10 known in the prior art. The press 10 generally includes an unwind station 12, four printing stations 14*a*, 14*b*, 14*c*, 14*d*, a die cutting and lamination station 16, and a final product station 18. More or less than four printing stations could be provided. Referring also to FIG. 2, a partial perspective view of one of the printing stations 14 is shown. Each printing station 14 includes an ink doctor or applicator 20 with an inking roller 22, a printing roller 24, a backing or impression roller 26, and a dryer 28. Individual ink supplies 30 are separately connected to the ink applicators 20.

The printing stations 14 are all mounted to the frame 32 of the press 10 in a general cantilever fashion. More specifically, the components of the printing stations extend in a forward direction (as indicated by arrow A) from the front of the frame 32. Referring particularly to FIG. 2, the ink applicator 20 is connected to the front of the frame 32 in general cantilever fashion. The backing roller 26 is connected to the front of the frame 32 in general cantilever fashion. The printing roller 24 generally includes a printing cylinder 34 rotatably and removably mounted on a plate roll shaft or printing cylinder support 36. The support 36 generally comprises a vertical movement member 38 movably connected to the printing press frame 32, a cylinder rod 40, and a cantilevered support member 42. The vertical movement member 38 is adapted to move up and down on the frame 32, as indicated by arrow B, about 2 to 3 inches to allow for cleaning or replacement of printing cylinder 34 and, to allow for proper positioning of different printing cylinders having different diameters. The cantilevered support member 42 has a first end 44 stationarily connected to the vertical movement member 38. Thus, when the vertical movement member 38 is moved up and down, the cantilevered support member 42 is moved with it. The cylinder rod 40 also has a first end 46 stationarily connected to the vertical movement member 38 and a second end 48 that is connected to the outward cantilevered end of the cantilevered support member 42. The printing cylinder 34 is rotatably supported on the cylinder rod 40. A vertical movement mechanism is provided with a manual crank 50 and an automatic system (not shown). The manual crank 50 is connected between the vertical movement member 38 and the frame 32. When the crank 50 is rotated, the vertical movement member 38 moves up or down on the frame 32. This is used to control the pressure between the printing cylinder 34 and the backing roller 26 for controlling the quality of the ink application from the printing cylinder 34 to the web passing between the two rollers 24, 26. The automatic system (not shown) automatically moves the vertical movement member 38 in an upward direction when the press 10 is stopped and in a downward direction when the press 10 is restarted.

Figure 4:
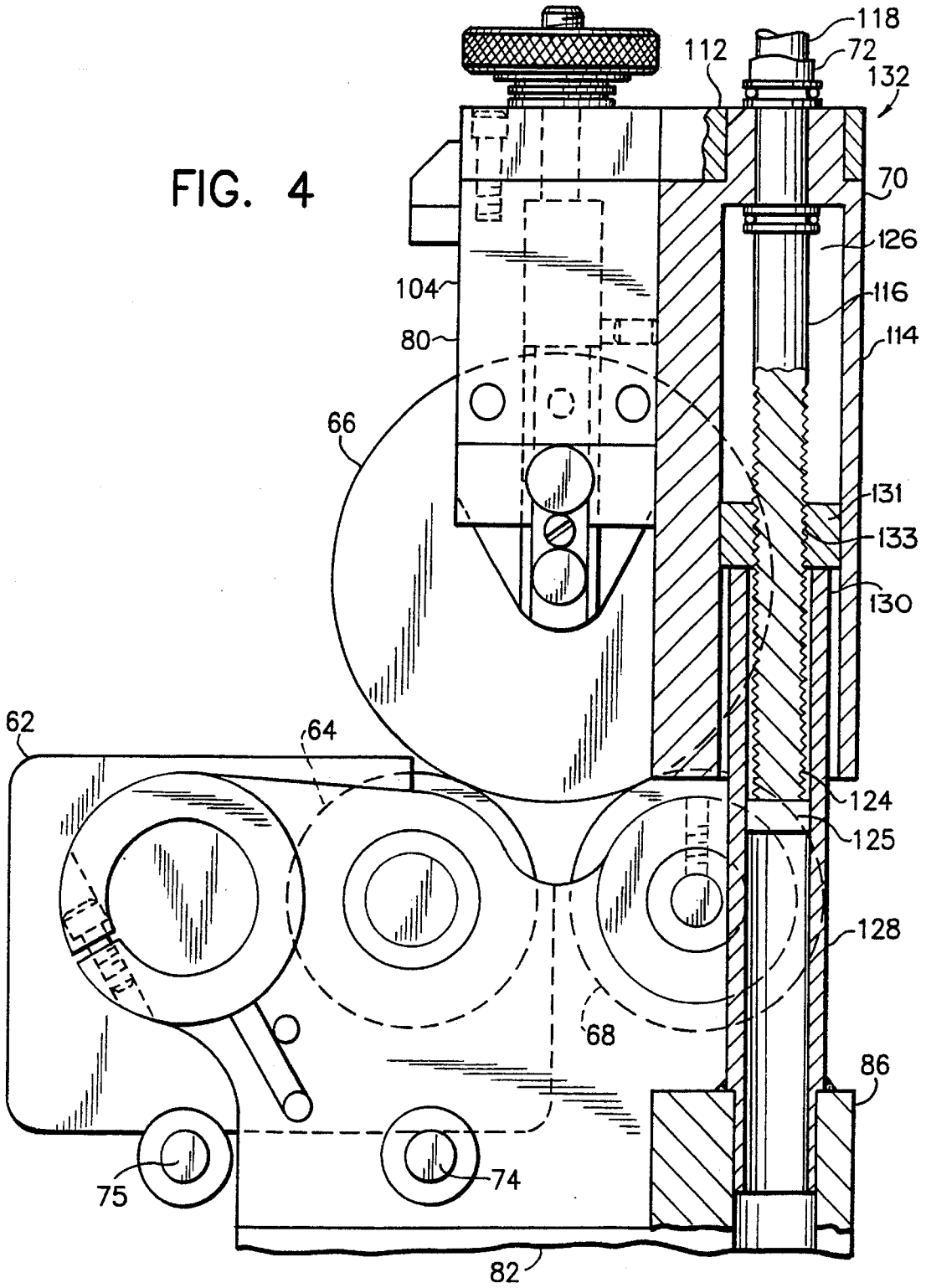
FIG. 4 is a partial front elevational view with cut-away sections of the printing station shown in FIG. 3.

Referring now to FIGS. 3 and 4, the printing station 60 of the present invention is shown. The printing station 60 is used with the printing press 10. More specifically, individual printing stations 60 replace respective ones of the printing stations 14. The printing station 60 includes an ink applicator 62 with an inking roller 64, a printing roller 66, a backing or impression roller 68, a frame extension 70, and a movement transmission 72. The ink applicator 62 is substantially similar to the ink applicator 20 known in the prior art. Two bottom support rods 74, 75 support the bottom of the ink applicator 62. The support rods 74, 75 are connected to the front of the frame 32 at a first end. One of the rods 75 has a cantilevered opposite end. The other rod 74 has its opposite end connected to a portion of the frame extension 70. The inking roller 64 has a first inward end 76 that is connected to the frame 32 and an outward end 78 that is connected to a portion of the frame extension 70.

The frame extension 70 generally comprises a first upper section 80 and a second lower section 82. The second lower section 82 includes a first bottom frame member 84 and a second bottom frame member 86. The first upper section 80 includes a first inward end 88 that is movably connected to the printing press frame 32 and a second outward end 90. The second end 90 is movably connected to the second lower section 82.

The first inward end 88 of the first upper section 80 includes a rear vertical movement member 92 that is substantially similar to the vertical movement member 38 in the prior art. The vertical movement member 92 is adapted to move up and down on the frame 32. An inner end 94 of an upper frame extension piece 96 is stationarily connected to the vertical movement member 92. The vertical movement mechanism for moving the vertical movement member 92 up and down on the frame 32 is substantially identical to the prior art movement mechanism. However, the prior art crank 50 has been replaced with a driven pulley 98 connected at the top of the drive shaft 100. The rear vertical movement mechanism includes an inward automatic pneumatic vertical mover 91. The automatic mover 91 is connected to the control electronics of the press 10 for automatically moving the vertical movement member 92 up, such as when the operator actuates a stop switch or when a detector, such as a web break detector, counter detector, waste detector, or end of roller detector, is actuated. The automatic mover 91 is adapted to move the member 92 about 1/16 of an inch. The end 94 has an inward end of the cylinder rod 102 removably connected thereto.

Figure 5:
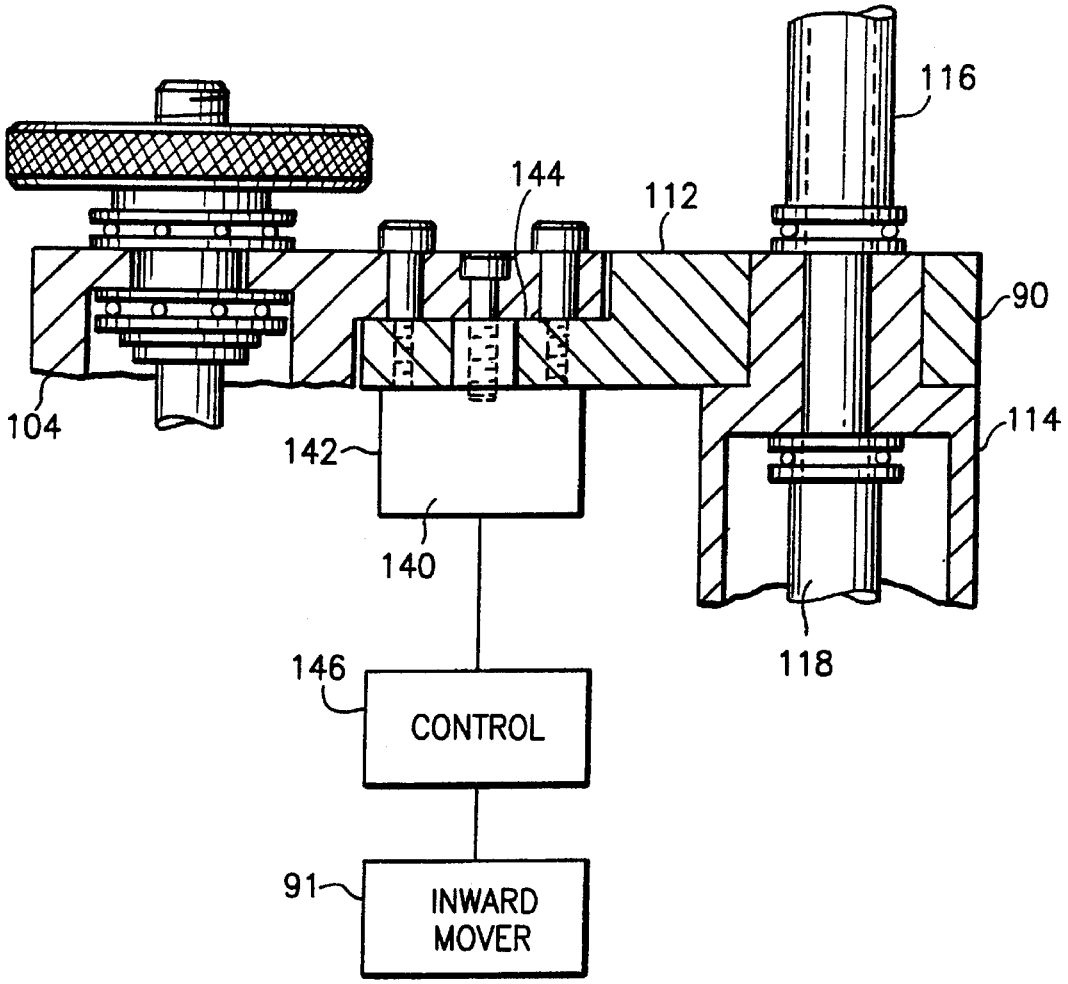
FIG. 5 is an enlarged partial cross-sectional and schematic view of a portion of the printing station shown in FIG. 4 and the press control.

The upper frame extension piece 96 has an outward end 104. The outward end 104 has an outward end of the cylinder rod 102 connected thereto. The outward end 104 also has an adjustment mechanism 106 that cooperates with the spring 108 to adjust the centering of the printing cylinder 110. Referring also to FIG. 5, a connecting frame piece 112 connects the outward end 104 of the upper frame extension piece 96 to a frame piece 114 of a front vertical movement mechanism 116 that forms the front outward end 90 of the upper section 80.

Referring also to FIG. 4, the front vertical movement mechanism 116 includes the frame piece 114, a front drive shaft 118, a pulley 120, and a hand crank 122. The frame piece 114 is connected to the upper frame extension piece 96 by the connecting frame piece 112 as described below. The pulley 120 and the hand crank 122 are fixedly connected to the top of the front drive shaft 118. The front drive shaft 118 extends through the connecting piece 112 and into an interior channel 126 of the frame piece 114. The front drive shaft 118 is axially rotatable relative to the frame piece 114 and the connecting piece 112. A bottom end 124 of the front drive shaft 118 has a threaded section with an end stop 125 fixedly connected thereto. The second bottom frame member 86 has a tube 128 welded thereto. The tube 128 is coaxially aligned with the drive shaft 118 and the interior channel 126 of the frame piece 114. A top end 130 of the tube 128 has a member 131 fixedly connected thereto with an interior threaded section 133. The bottom end 124 of the drive shaft 118 is threadingly mounted in the threaded section 133. When the drive shaft 118 axially rotates relative to the tube 128 and member 131, the drive shaft 118 is able to move up and down in the tube 128.

The front drive shaft 118, although axially rotatable relative to the frame piece 114, is not longitudinally movable relative to the frame piece 114. More specifically, the connection of the front drive shaft 118 to the frame piece 114 at area 132 longitudinally fixedly connects the front drive shaft 118 to the frame piece 114. Thus, when the front drive shaft 118 longitudinally moved up and down on the member 131, the frame piece 114 is also longitudinally moved up and down relative to the tube 128. Because the tube 128 is stationarily connected to the second bottom frame member 86 and the upper section 80 is connected to the frame piece 114, axial rotation of the front drive shaft 118 causes the upper section 80 to move relative to the lower section 82. Because the printing roller 66 is connected to the upper section 80 and the inking roller 64 and backing roller 68 are connected to the lower section 82, axial rotation of the front drive shaft 118 moves the printing roller 66 up and down relative to the other two rollers 64, 68.

The second outward end 90 of first upper section 80 includes an outward automatic pneumatic vertical mover 140. The outward automatic mover 140 includes a pneumatic drive 142 operably connected to the outward end 104 of piece 96 and the frame piece 112 at joint 144. The outward automatic mover 140 is operably connected to the press control 146. Similar to the inward automatic mover 91, the outward automatic mover 140 is adapted to move the outward end 104 of the piece 96 upward about 1/16 of an inch on the frame piece 112. The control 146 operates the two automatic movers 91, 140 at the same time to uniformly lift and lower the opposite ends of the upper frame extension piece 96 at the same time.

Referring to FIG. 3, the movement transmission 72 includes a drive belt 134. The belt 134 is operably connected between the rear drive pulley 98 and the front drive pulley 120. When a user rotates the hand crank 122 the front pulley 120 moves the belt 134. This, in turn, rotates the rear drive pulley 98. Thus, the two drive shafts 100 and 118 are axially rotated in unison with each other. This dual drive shaft system allows the first inward end 88 of the first upper section 80 to be moved up and down in unison with the movement of the second outward end 90. This allows the printing roller 66 to be moved up and down without canting or tilting that might otherwise cause improper positioning with the other rollers 64, 68 for good uniform printing along the length of the printing roller 66.

The prior art printing stations 14 were limited to a printing cylinder length of about 7 inches to about 8 inches. This limitation was due to the cantilevered mounting of the rollers 22, 24, 26 from the frame 32 and, the requirement for suitable pressure to be exerted by the printing roller 24 against the backing roller 26 for good ink application on the web being printed on. The present invention has been developed to allow for printing cylinders longer than 8 inches in length, but still allow sufficient printing pressure and still allow for an open front design. The present invention uses a cantilevered truss-like design rather than a simple cantilevered design. More specifically, the frame extension 70 uses the stationary second lower section 82 and the vertically movable first upper section 80 to form the cantilevered truss design. The present invention does not extend the outward end of the extension 70 to the floor because of problems that could develop regarding leveling and vibrations. The cantilevered truss design eliminates the leveling and vibration problems. Because the two sections 80, 82 are both attached to the frame 32 and to each other, the frame extension 70 allows for longer printing cylinders to be used while maintaining sufficient printing pressure for good printing. The dual drive shaft movement mechanism and movement transmission 72 still allow level manual raising and lowering of the printing roller. The dual automatic movers 91, 140 also still allow level automatic raising and lowering of the printing roller. The printing stations of the present invention also allow the old printing presses 10 to be retrofitted with the new printing stations 60 without the need to replace the entire press 10. In alternate embodiments other types of transmissions, frame constructions, and/or vertical drive systems could be provided.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In a tag and label printing press having an unwind station, printing stations and a final product station arranged in series relative to each other, the printing stations being serially arranged on a frame of the printing press, each printing station having an ink roller, a printing roller and a backing roller, all of the printing station rollers extending outwardly from the frame, the improvement comprising:

at least one of the printing stations having a frame extension connecting outward ends of the printing station rollers to each other.

2. A printing press as in claim 1 wherein the frame extension has a first section movably connected to the printing press frame and a second section stationarily connected to the printing press frame.

3. A printing press as in claim 2 wherein the first section has a first end that is movably connected to the printing press frame and a second end that is movably connected to the second section.

4. A printing press as in claim 3 further comprising means for moving the second end on the second section in unison with movement of the first end on the printing press frame.

5. A printing press as in claim 4 wherein the means for moving includes a hand crank on the second end and a belt extending from the hand crank to a movement member on the first end.

6. A printing press as in claim 1 wherein the frame extension is connected to the printing press frame both below and above the printing station rollers.

7. A method of modifying a tag and label printing press comprising steps of:

removing a generally cantilevered printing roll support frame from a frame of the printing press, the support frame having been movably mounted on the printing press frame; and connecting a frame extension to the printing press frame, a first portion of the frame extension being movably mounted to the printing press frame at a location where the support frame was previously mounted to the printing press frame, and a second portion of the frame extension being stationarily connected to the printing press frame.

8. A method as in claim 7 wherein the step of connecting includes connecting a transmission belt between a movement member connected to the printing press frame at one end of the first portion and a hand operated crank connected to an opposite end of the first portion.

9. A method as in claim 7 wherein the step of connecting includes movably connecting an outward end of the first portion to an outward end of the second portion.

10. A printing station for a tag and label printing press, the printing station comprising:

rollers including a printing roller and a backing roller; and an extension frame having a first section with a first end movably connectable to a printing press frame and a second end connected to an outward end of the printing roller, and a second section with a third end connected to an outward end of the backing roller and a fourth end stationarily connectable to the printing press frame, wherein the first and second sections are movably connected to each other.

11. A printing press as in claim 10 wherein the second end is movably connected to the second section.

12. A printing press as in claim 11 further comprising means for moving the second end on the second section in unison with movement of the first end of the printing press frame.

13. A printing press as in claim 12 wherein the means for moving includes a hand crank on the second end and a transmission belt extending from the hand crank to a movement member on the first end.

14. A printing press as in claim 10 wherein the extension frame is connected to the printing press frame both below and above the printing station rollers.

* * * * *